US010907349B2

(12) United States Patent
Fang et al.

(10) Patent No.: US 10,907,349 B2
(45) Date of Patent: Feb. 2, 2021

(54) CLADDING SYSTEM INCLUDING A FLEXIBLE GRID AND PANELS

(71) Applicant: CertainTeed Ceilings Corporation, Malvern, PA (US)

(72) Inventors: Chunwei Fang, Providence, RI (US); Joyce G. Kutty, North Providence, RI (US); Taylor J. McCabe, Providence, RI (US); Sara Naja, Cambridge, MA (US); Stefan M. Sehringer, Providence, RI (US); Emily Robertson, Cambridge, MA (US)

(73) Assignee: CertainTeed Ceilings Corporation, Malvern, PA (US)

( * ) Notice: Subject to any disclaimer, the term of this patent is extended or adjusted under 35 U.S.C. 154(b) by 0 days.

(21) Appl. No.: 16/437,347

(22) Filed: Jun. 11, 2019

(65) Prior Publication Data

US 2019/0376285 A1 Dec. 12, 2019

Related U.S. Application Data

(60) Provisional application No. 62/683,614, filed on Jun. 11, 2018.

(51) Int. Cl.

| | |
|---|---|
| ***E04B 9/16*** | (2006.01) |
| ***E04B 9/00*** | (2006.01) |
| ***E04B 9/04*** | (2006.01) |
| ***E04B 9/18*** | (2006.01) |
| ***E04B 9/28*** | (2006.01) |

(52) U.S. Cl.

CPC ..... *E04B 9/16* (2013.01); *E04B 9/001* (2013.01); *E04B 9/0435* (2013.01); *E04B 9/18* (2013.01); *E04B 9/28* (2013.01)

(58) Field of Classification Search

CPC ... E04B 9/16; E04B 9/06; E04B 9/001; E04B 9/0435; E04B 9/18; E04B 9/28

See application file for complete search history.

(56) References Cited

U.S. PATENT DOCUMENTS

| | | | | |
|---|---|---|---|---|
| 3,380,206 | A * | 4/1968 | Barnett | E04B 9/001 52/145 |
| 3,386,220 | A | 6/1968 | Staats | |
| 3,857,216 | A * | 12/1974 | Sherman | E04B 9/26 52/506.06 |
| 3,969,865 | A * | 7/1976 | Andersen | E04B 9/068 52/506.07 |

(Continued)

FOREIGN PATENT DOCUMENTS

| | | |
|---|---|---|
| EP | 0237504 A2 | 9/1987 |
| FR | 1399726 A | 5/1965 |
| FR | 3012160 A1 | 4/2015 |

*Primary Examiner* — Beth A Stephan

(74) *Attorney, Agent, or Firm* — McDonnell Boehnen Hulbert & Berghoff LLP

(57) ABSTRACT

The present disclosure relates generally to cladding that forms an architectural surface, for example, suitable for forming a ceiling. The present disclosure relates more particularly to a cladding system including a plurality of flexible grid members arranged so as to form a grid that extends in at least two dimensions and includes grid cells that are delimited by the flexible grid members and a plurality of panels supported by the grid. At least a first portion of the panels are arranged so as to form an architectural surface.

20 Claims, 8 Drawing Sheets

(56) References Cited

U.S. PATENT DOCUMENTS 4,115,970 A * 9/1978 Weinar ..... E04B 9/06 403/230
4,450,656 A 5/1984 Lagendijk
4,720,946 A * 1/1988 Pagliarello ..... E04B 9/22 52/127.7
4,848,054 A * 7/1989 Blitzer ..... E04B 9/005 52/506.07
4,869,031 A * 9/1989 Mallory ..... E04B 9/003 52/127.8
5,239,801 A * 8/1993 Adams ..... E04B 9/0478 52/506.07
5,421,132 A * 6/1995 Bischel ..... E04B 9/068 52/311.3
5,611,185 A * 3/1997 Wilz ..... E04B 9/001 52/395
5,845,447 A * 12/1998 Bodine ..... E04B 9/0478 52/506.09
6,092,777 A 7/2000 Kuntz
6,205,733 B1 * 3/2001 LaLonde ..... E04B 9/067 52/506.07
6,233,881 B1 5/2001 Rainbolt
6,386,263 B1 * 5/2002 Tomlinson ..... E04B 9/001 160/328
6,536,173 B2 * 3/2003 Rebman ..... E04B 9/068 52/465
6,637,173 B1 * 10/2003 Wheeler ..... E04B 2/7457 52/241
6,701,686 B1 * 3/2004 Platt ..... E04B 9/02 52/506.07
7,406,802 B2 * 8/2008 Stackenwalt ..... E04B 9/0414 52/22
8,028,791 B2 * 10/2011 Kliegle ..... E04B 1/8236 181/287
RE46,043 E * 6/2016 Stackenwalt ..... E04B 9/0414
2002/0152704 A1 * 10/2002 Thompson ..... E04F 19/02 52/506.06
2003/0205016 A1 11/2003 Gulbrandsen

* cited by examiner

CLADDING SYSTEM INCLUDING A FLEXIBLE GRID AND PANELS

CROSS-REFERENCE TO RELATED APPLICATIONS

This application claims the benefit of priority of U.S. Provisional Patent Application 62/683,614, filed Jun. 11, 2018, which is hereby incorporated herein by reference in its entirety.

BACKGROUND OF THE DISCLOSURE

1. Field of the Disclosure

The present disclosure relates generally to cladding that forms an architectural surface, for example, suitable for forming a ceiling. The present disclosure relates more particularly to a cladding system that includes a flexible grid and panels supported by the flexible grid.

2. Technical Background

Cladding systems that include a grid that holds corresponding panels are effective for constructing an attractive architectural and performative surface. For example, a suspension ceiling including a ceiling grid and acoustic ceiling tiles provides an attractive surface allowing the builder to provide a clean and uninterrupted boundary to the space below the ceiling while hiding infrastructure such as structural members, heating, ventilation and air conditioning (HVAC) components, wiring, and plumbing in a plenum space above the ceiling. Further, such cladding systems provide the benefit of being modular. If work needs to be done behind the architectural surface, a small portion can be temporarily removed to provide access above or behind the surface.

Conventional cladding systems typically use a rigid and fixed grid layout to support the corresponding panels. For example, ceiling grids are typically constructed using steel t-beams that are manufactured to standard dimensions and installed at straight angles. While these ceiling grids are effective once constructed, they are inflexible in adapting to unique spaces. As a result, placing ceiling grid in a unique space can require a painstaking process of measuring and cutting the steel beams to exact dimensions so that the rectangular grid fits within the irregular space.

The present inventors have recognized that a cladding system that allows for easier customization to the installation space or area would be attractive to builders and designers.

SUMMARY OF THE DISCLOSURE

In one aspect, the present disclosure provides a cladding system comprising:

- a plurality of flexible grid members arranged so as to form a grid that extends in at least two dimensions and includes grid cells that are delimited by the flexible grid members; and
- a plurality of panels supported by the grid, at least a first portion of the panels being arranged so as to form an architectural surface.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

Figure 1:
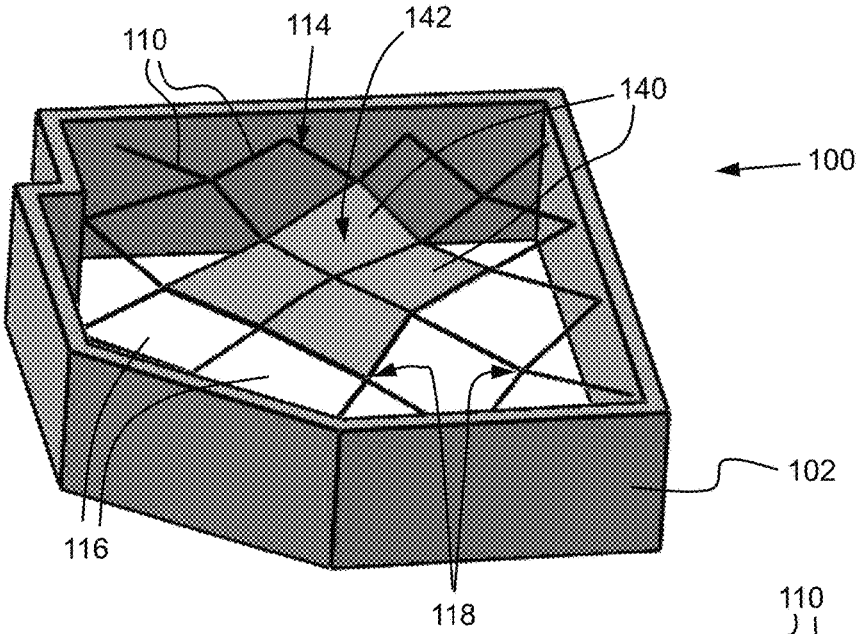
FIG. 1 is a schematic perspective view of a cladding system surrounded by a support structure in accordance with an embodiment of the disclosure.
Figure 2:
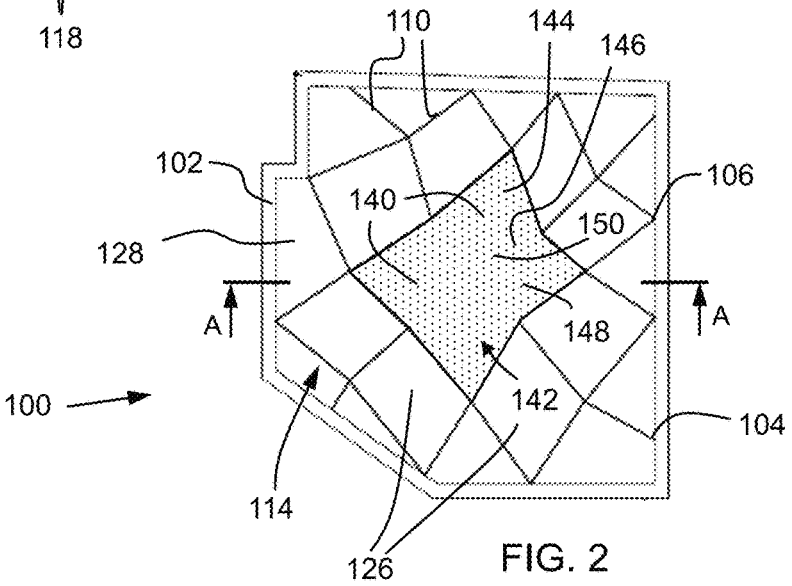
FIG. 2 is a schematic top view of the cladding system of FIG. 1.

As described above, the present inventors have noted that conventional cladding systems, such as ceiling systems, are difficult to install in a manner that conforms to the space in which they are installed. Accordingly, one aspect of the disclosure is a cladding system including a plurality of flexible grid members arranged so as to form a grid that extends in at least two dimensions and includes grid cells that are delimited by the flexible grid members. A plurality of panels are supported by the grid and at least a first portion of the panels are arranged so as to form an architectural surface. Such a cladding system is shown in perspective view in FIG. 1. Cladding system 100 includes a plurality of flexible grid members 110 that extend across a two-dimensional space bound by a support structure 102. Flexible grid members 110 are laid out across the two-dimensional space so as to form a grid 114 that includes a plurality of grid cells 116 that are delimited by the flexible grid members. Cladding system 100 also includes four panels 140 that are supported by flexible grid members 110 and form an architectural surface 142.

The flexible members as described herein are adjustable in shape and can readily conform to desired shapes. For example, the flexible members will change shape under the force of gravity if draped over a supporting object. Examples of suitable flexible members include ropes, cables, straps and cords. In certain embodiments, the flexible members include metal, such as metal strands. In other embodiments, the flexible members include polymer fibers. For example, in some embodiments the flexible members are nylon ropes or straps.

In certain embodiments as otherwise described herein, the cladding system is a ceiling system, the grid is a ceiling grid, and the first portion of panels forms a ceiling surface that covers a space beneath the ceiling grid. For example, cladding system 100 is a ceiling system that is surrounded by walls 102. The grid 114 is a ceiling grid that is supported by the surrounding walls 102 and spans the two-dimensional space inside the walls. The four panels 140 form a ceiling surface 142 above the central region of the two-dimensional space.

In other embodiments, the cladding system is a wall covering that extends vertically over a wall. In some embodiments the wall covering is an interior wall covering, while in other embodiments the wall covering is an external wall cladding. Still in other embodiments, the cladding system is a roof system and the panels are roofing panels.

The use of a flexible grid allows the cladding system to conform to the shape of the environment or space where it is installed. For example, in a ceiling system, the flexible grid elements enable the cladding system to conform to irregular shaped walls including oddly shaped recesses or protrusions. Likewise, the flexible grid members allows the grid and cladding system to conform to structural elements or fixtures in the ceiling, such as columns, lights and vents. Such conformity with a rigid conventional ceiling grid is difficult and requires careful and customized installation.

Figure 5:
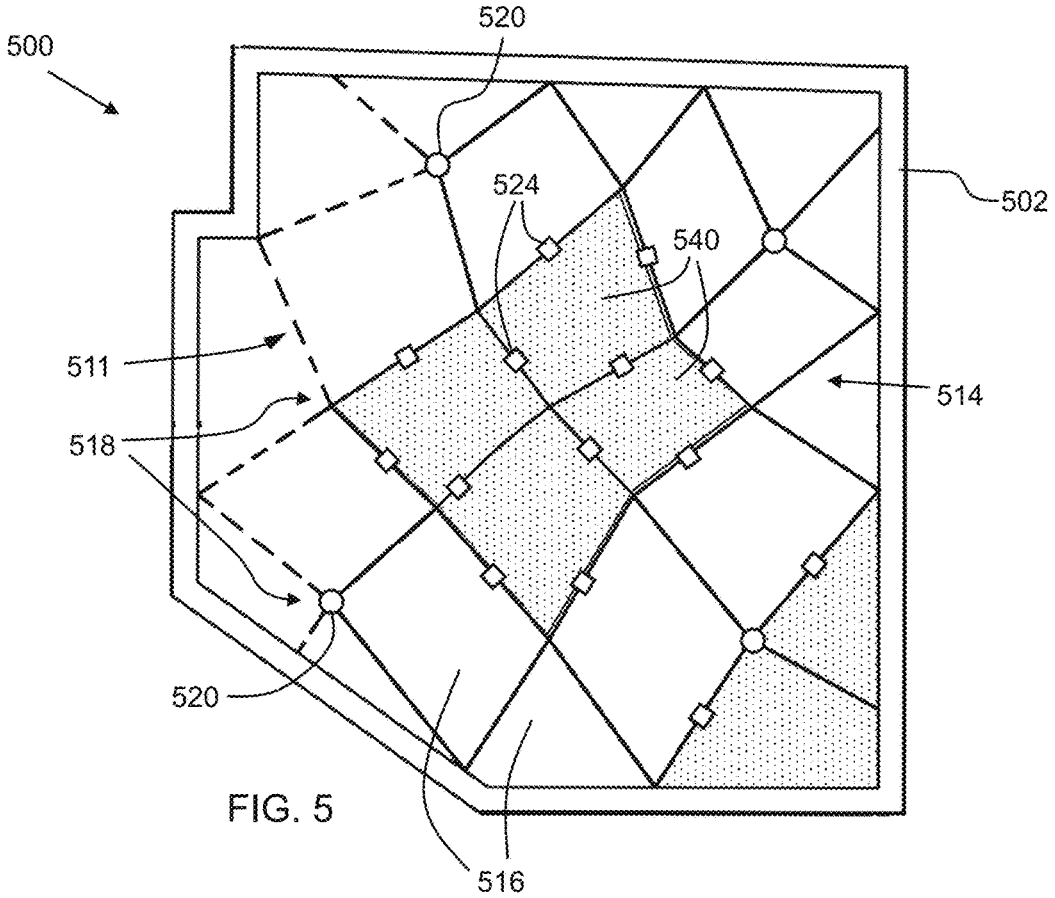
FIG. 5 is a schematic top view of a cladding system according to another embodiment of the disclosure.

In certain embodiments as otherwise described herein, the flexible grid members are held together at nodes so as to form the grid cells. For example, in cladding system 100, the flexible grid members 110 come together at nodes 118. In some embodiments, the flexible grid members are directly attached to one another at the nodes, as described in more detail below. In other embodiments, the flexible grid members are arranged with the panels so as to meet at the nodes without being directly connected to one another. In certain embodiments, meander across the two-dimensional space from one node to the next. For example, in cladding system 500, which is shown in FIG. 5 with a dashed line for emphasis, flexible grid member 511 meanders between a support wall 502 and several nodes 518. In other embodiments, the flexible grid members cross, thereby forming nodes at the intersection point.

In certain embodiments as otherwise described herein, the panels define the shape of the grid cells. For example, in some embodiments, the flexible grid members and panels cooperate to define the shape of the grid. For instance, in some embodiments the flexible grid members hold up the panels while the panels define the position and paths of the flexible grid members.

In certain embodiments as otherwise described herein, the grid includes node clips that secure respective flexible grid members together at the nodes. For example, in ceiling system 500, node clips 520 hold adjacent flexible grid members 510 together at various nodes 518 across the grid 514. While grid 514 only includes node clips 520 in the locations where the surrounding grid cells 516 are empty, in other embodiments the node clips are also disposed in locations adjacent to a panel. For example, in some embodiments, the flexible grid members are held together by node clips at each node in the grid.

In certain embodiments as otherwise described herein, the node clips also secure respective panels of the plurality of panels. For example, in some embodiments, corners of the panels are attached to the flexible grid members of the grid by the node clips.

In certain embodiments as otherwise described herein, the first portion of panels includes a first panel including a first panel edge and a second panel including a first panel edge. The first panel edge of the first panel runs parallel and adjacent to the first panel edge of the second panel so as to form a continuous surface. For example, in cladding system 100 the panels include a first panel 144 that has first panel edge 146 and a second panel 148 that has first panel edge 150. The respective first panel edges 146, 150 of panels 144 and 148 are parallel and adjacent so as to form a contiguous surface therebetween, in this case a ceiling surface.

The term parallel, as used herein, is not limited to perfectly parallel lines, but also includes slight variances resulting from construction processes. In particular, as used herein, the term parallel includes lines or edges that have an angle between one another of no greater than 3 degrees.

Figure 4:
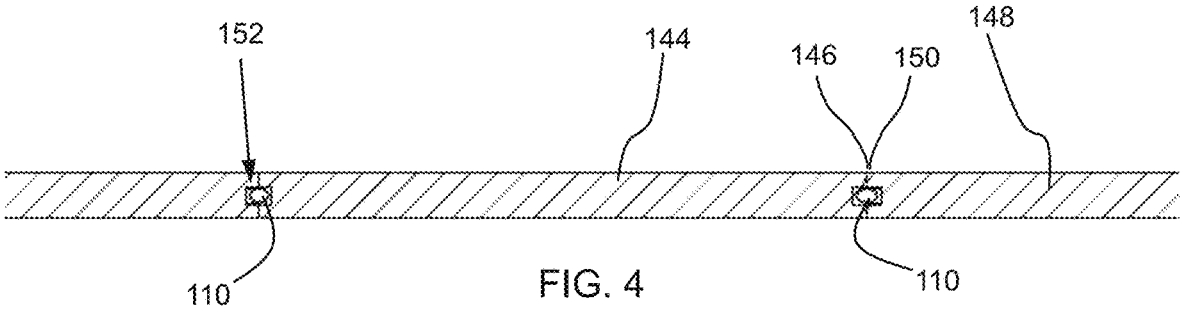
FIG. 4 is a schematic detailed cross sectional side view of a portion of the cladding system of FIG. 1.

In certain embodiments as otherwise described herein, the first panel edge of the first panel abuts the first panel edge of the second panel. For example, as shown in FIG. 4, first panel edge 146 of first panel 144 directly abuts first panel edge 150 of second panel 148. To form such an abutment, the panels 144 and 148 extend around flexible grid member 110 so as to contact one another, as explained in more detail below.

Figure 6:
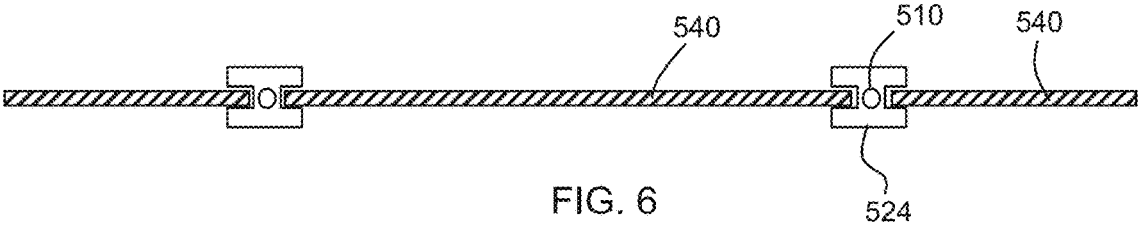
FIG. 6 is a schematic detailed cross sectional side view of a portion of the cladding system of FIG. 5.

In certain embodiments as otherwise described herein, the first panel edge of the first panel is separated from the first panel edge of the second panel by a gap of no more than 3 inches, e.g., no more than 2 inches, e.g., no more than 1 inch. For example, as shown in the detailed cross-sectional view of system 500 depicted in FIG. 6, panels 540 are held spaced apart at a small distance by support clips 524 attached to the flexible grid members 510 as described in more detail below. In other embodiments the panels are held apart by the flexible grid members. For example, in some embodiments the flexible grid members are wide straps that are inserted into edge grooves in the panels such that the straps hold the panels at a distance from one another.

Figure 7:
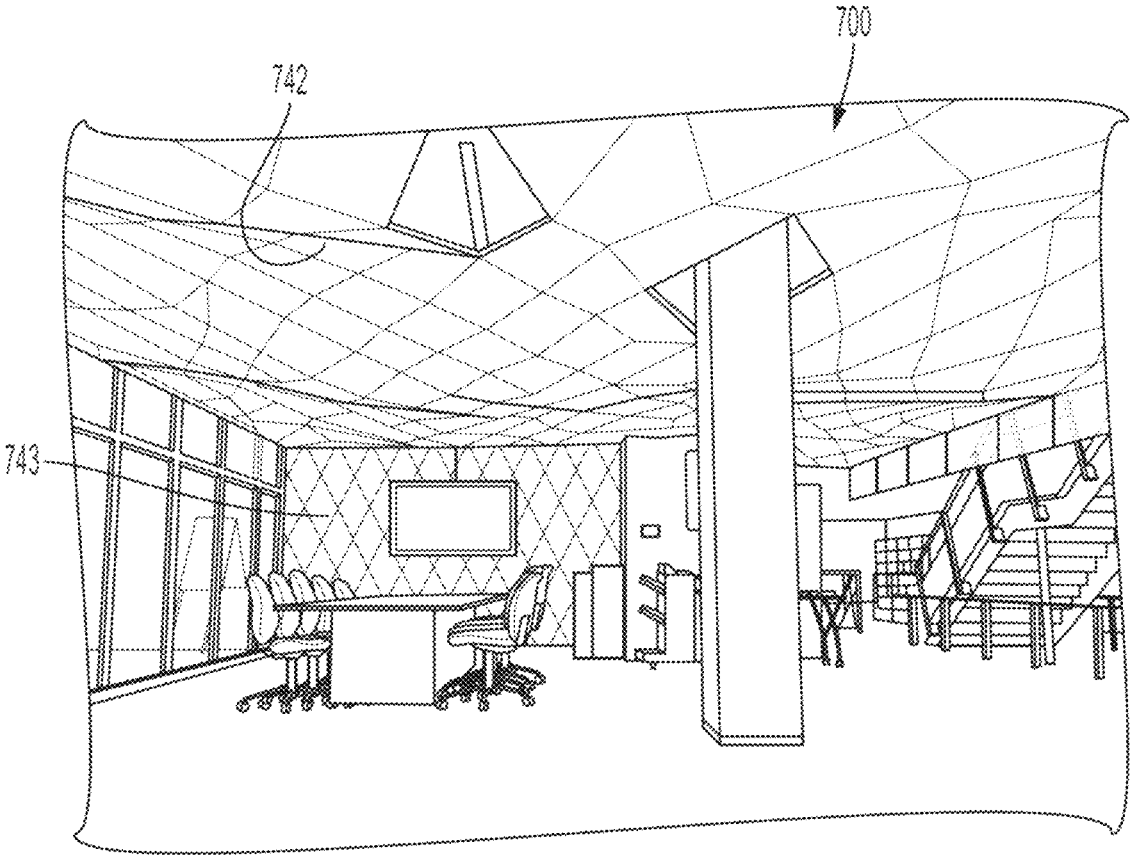
FIG. 7 is a digital rendering of a cladding system according to another embodiment of the disclosure.
Figure 8:
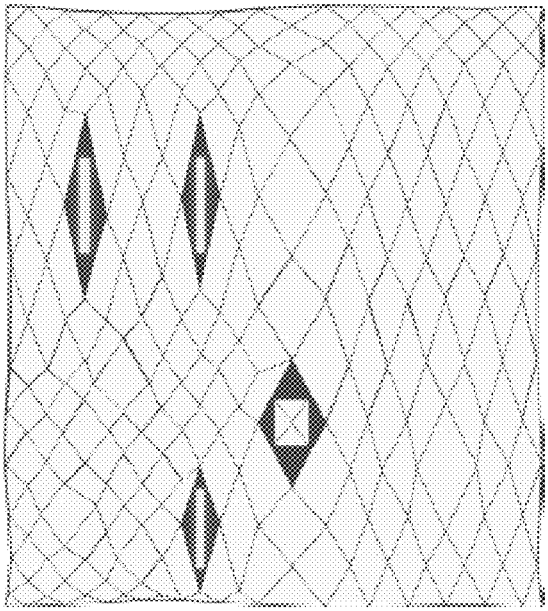
FIG. 8 is a schematic top view of the cladding system of FIG. 5.

In certain embodiments as otherwise described herein, the first portion of panels includes at least 4 panels, e.g., at least 9 panels, e.g., at least 12 panels. For example, cladding system 500 includes a first portion of panels 540 in a group of four that form an architectural ceiling surface 542 at the center of grid 514. Cladding system 500 also includes a smaller portion of the panels 540 in a corner of the grid. In other embodiments, a larger group of panels form an architectural surface. For example, in cladding system 700 shown in FIG. 7, a portion of the panels form a ceiling surface 742, while a second portion of panels form a wall covering 743. In other embodiments, the grid includes a plurality of panels with a first portion of the panels disposed in a group so as to form an architectural surface at one location and a second portion of the panels disposed in another group to form an additional architectural surface. For example, in some embodiments, the panels are grouped throughout the grid in specific locations, such as above a table or work station, while other parts of the grid are left empty.

In certain embodiments as otherwise described herein, each of the panels in the first portion includes at least one edge that runs parallel and adjacent to an edge of an adjacent panel. For example, the first portion of panels 540 in cladding system 500 are grouped together such that each of these panels has two edges that are adjacent and parallel to the edges of a neighboring panel. A second portion of the panels 540 in cladding system 500 includes two panels that each have an edge that is adjacent and parallel to the other.

Figure 10:
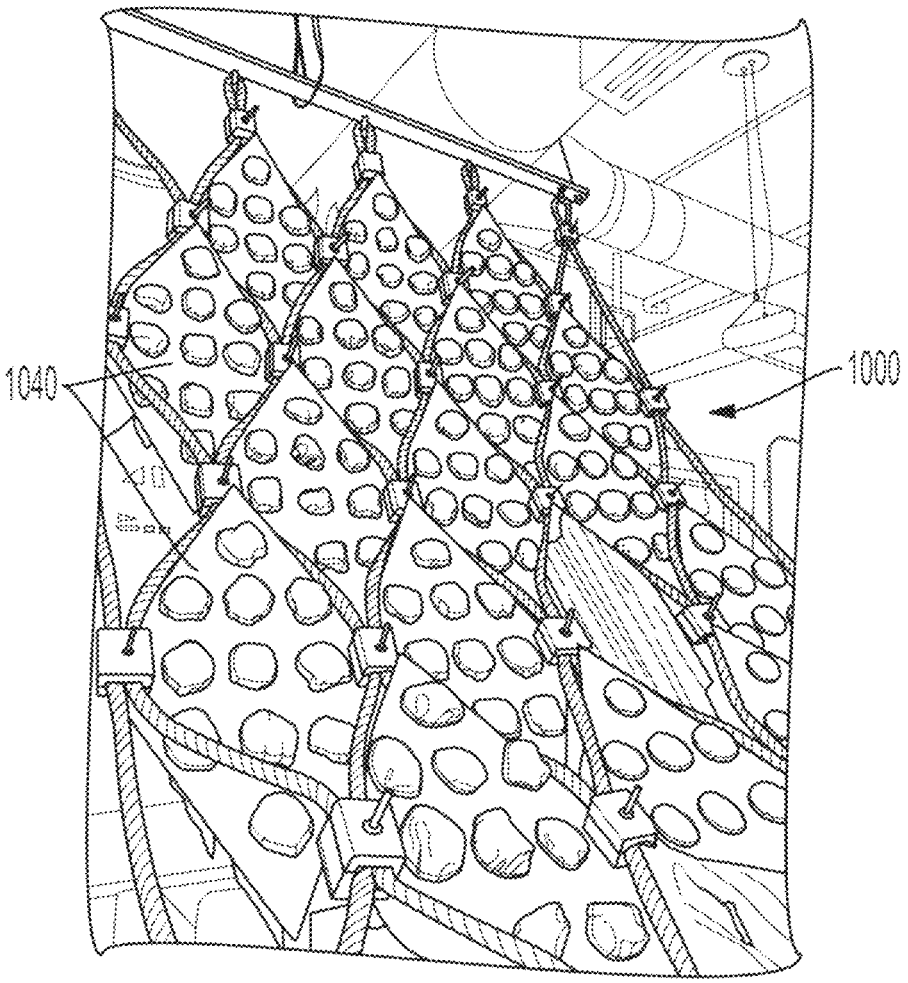
FIG. 10 is a perspective view of a cladding system according to another embodiment of the disclosure.

In certain embodiments as otherwise described herein, each of the panels in the first portion overlaps an adjacent panel. For example, the panels 1040 in cladding system 1000, shown in FIG. 10, have two edges that respectively overlap edges of a neighboring panel.

In certain embodiments as otherwise described herein, the grid includes anchors that secure ends of the flexible grid members to a support structure. For example, in the cladding system 100, shown in FIG. 1, embodied as a ceiling grid, a support structure is provided by walls 102. The ends of flexible grid members 110 are attached to the supporting walls 102 by anchors 104. Likewise, some of the flexible grid members 110 are attached to the supporting walls at intermediate locations with additional anchors 106. In some embodiments, the support structure is provided by a ceiling structure or a floor. For example, in some embodiments the cladding system is in the form of a ceiling system that spans a portion of a ceiling. In such an embodiment, a second ceiling structure that spans the remaining portion of the ceiling may serve as the support structure. Likewise, in some embodiments, the cladding system is a wall cover and a ceiling structure and floor provide the support structure for anchors of the flexible grid.

In certain embodiments as otherwise described herein, the grid cells include interior cells surrounded by edge cells at an outer perimeter of the grid. For example, in cladding system 100, the grid 114 includes a plurality of grid cells 116 including interior cells 126 that are each defined on all sides by the flexible grid and edge cells 128 at the outer perimeter of the grid 114. The edge cells 128 in system 100 are delimited by the flexible grid members 110 and by the supporting walls 102. In other embodiments, the edge cells are open at the outer edge of the grid. For example, in some embodiments, the grid is anchored to columns and the edge cells are left open between the columns.

In certain embodiments as otherwise described herein, substantially all of the interior cells have the same number of sides. For example, in cladding system 100 all of the interior cells 126 have the same number of sides.

In certain embodiments as otherwise described herein, substantially all of the interior cells have a shape selected from a group of no more than ten unique shapes, e.g., no more than five unique shapes, e.g., no more than three unique shapes. For example, in some embodiments, the cladding system is designed such that each of the interior panels is selected from a standard supply of ten different panel shapes. Accordingly, each of the interior panels in the cladding system is one of the five standard panel shapes. The interior cells likewise take the form of one of the ten standard shapes. In some embodiments, the edge cells are also occupied by one of the ten standard panel shapes and also conform to these shapes. In other embodiments, at least some of the edge cells differ in shape from the interior cells. For example, in some embodiments the edge cells are filled with panels that have been cut to unique shapes to conform to the surrounding support structure.

In certain embodiments as otherwise described herein, the interior cells have a quadrilateral shape. For example, the interior cells 126 in cladding system 100 are all quadrilateral. In other embodiments, the interior cells have a triangular shape.

Figure 11:
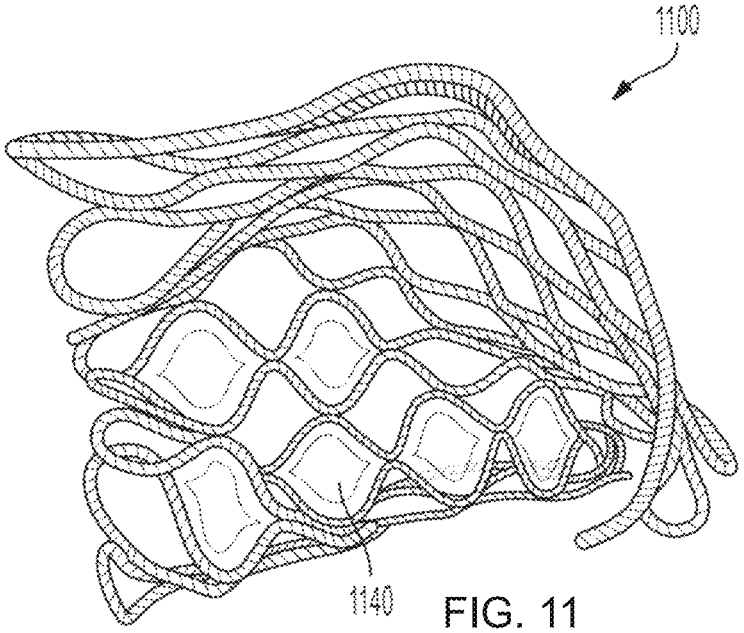
FIG. 11 is a perspective view of a cladding system according to yet another embodiment of the disclosure.

In certain embodiments as otherwise described herein, the panels have a curved edge and the cells likewise have a curved shape. For example, in cladding system 1100 shown in FIG. 11, the panels 1140 have a curved shape and the flexible members conform to the contour of the panels such that the cells also have a curved shape.

In certain embodiments as otherwise described herein, a majority of the grid cells have a unique shape. For example, in some embodiments, the cladding system is customized for a uniquely shaped space and most of the cells have a unique shape in order to provide a cladding system that conforms to the space.

Figure 3:
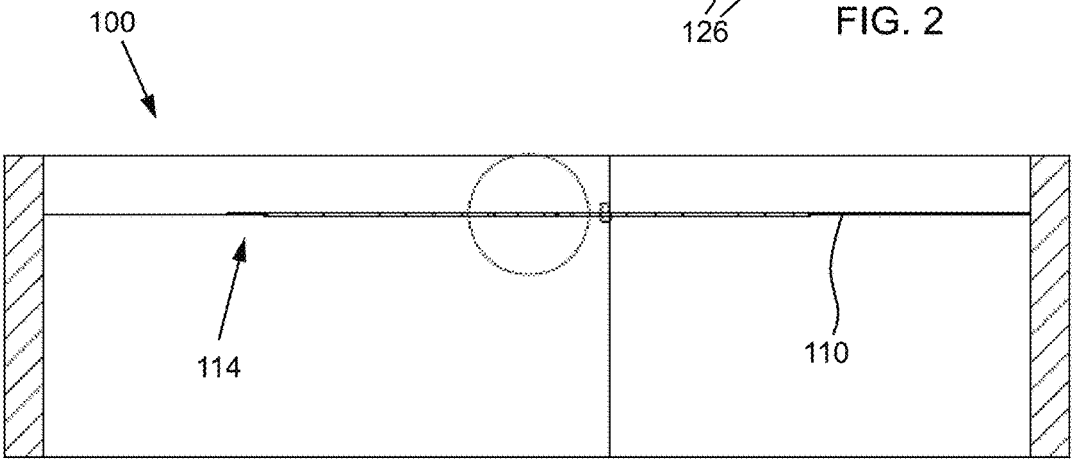
FIG. 3 is a schematic cross sectional side view of the cladding system of FIG. 1 taken along line A-A in FIG. 2.

In certain embodiments as otherwise described herein, the grid is planar. For example, as shown in FIG. 3, cladding system 100 includes a planar grid 114 such that the panels provide a two-dimensional ceiling structure. But in other embodiments, the grid is substantially non-planar, such that the panels provide a three-dimensional ceiling structure.

Figure 9:
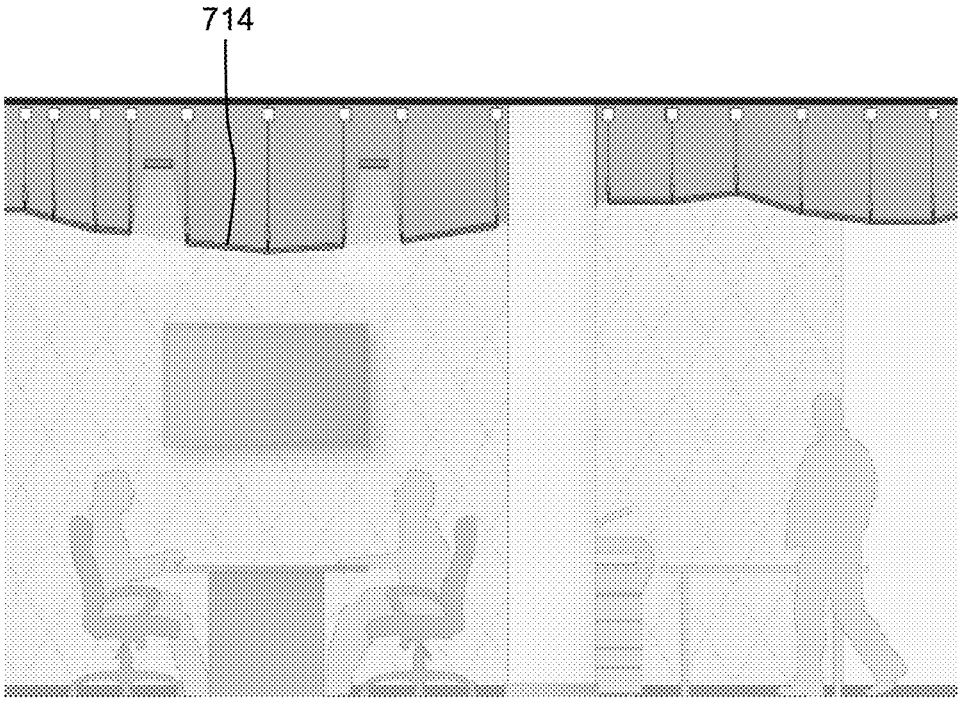
FIG. 9 is a schematic side view of the cladding system of FIG. 5 covering a living space.

In certain embodiments as otherwise described herein, the grid is undulating and has a three dimensional shape. For example, cladding system 700 includes an undulating grid 714 such that the ceiling structure provides a three dimensional surface. In some embodiments, the grid is supported by rods or tension lines at different distances from a supporting structure. For example, as shown in FIG. 9, grid 714 is held up by tension lines of various lengths.

Figure 12:
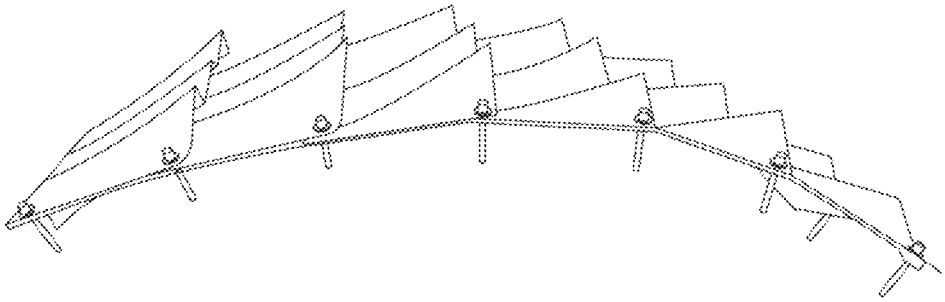
FIG. 12 is a perspective view of a cladding system according to yet another embodiment of the disclosure.
Figure 13:
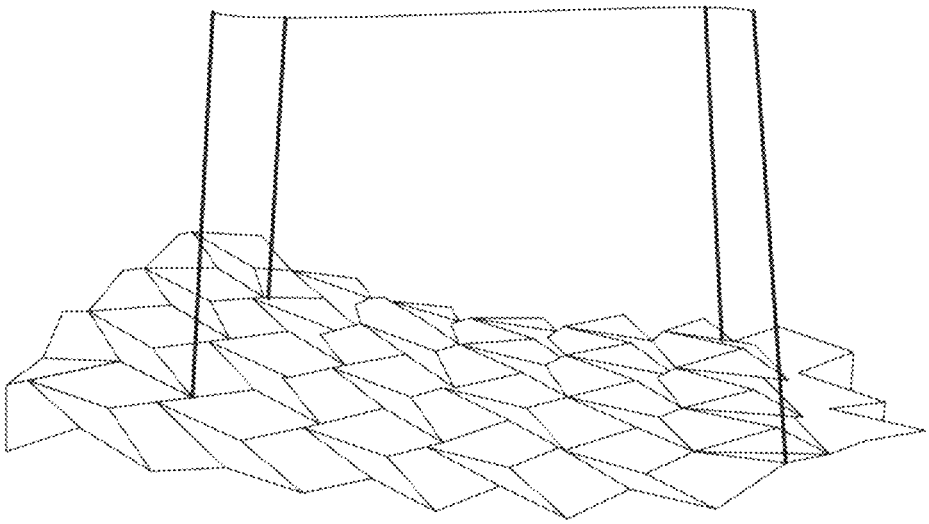
FIG. 13 is a perspective view of a cladding system according to another embodiment of the disclosure.

In certain embodiments as otherwise described herein, each of the panels is planar. For example, in cladding systems 100, 500 and 700 each of the panels is a flat planar element. In other embodiments, the panels are curved or faceted. Embodiments of such a cladding system are shown in FIGS. 12 and 13.

In certain embodiments as otherwise described herein, the panels are acoustic tiles. For example, in some embodiments, the panels are acoustic ceiling tiles. Such tiles can take a variety of different forms as will be appreciated by those of ordinary skill in the art, such as mineral fiber ceiling tiles. Other acoustic tiles are also possible.

In certain embodiments as otherwise described herein, the edges of the panels include grooves, and the flexible grid members are inserted into the grooves so as to support the panels. For example, as shown in the detailed view of FIG. 4, the panels 140 of cladding system 100 include edge grooves 152 and the flexible grid members 110 are held in grooves 152. Through their insertion into grooves 152, the flexible grid members 110 hold and support panels 140. Further, as described above, edge groove 152 allows panels 140 to extend around flexible grid members 110 such that the edges of neighboring panels abut.

In certain embodiments as otherwise described herein, the grid includes support clips disposed on the flexible grid members that hold the panels. For example, grid 514 of system 500 includes a plurality of support clips 524 disposed at various locations on the flexible grid members 510. The support clips 524 are fixed on the flexible grid members and hold the panels 540 in place.

In certain embodiments as otherwise described herein, each support clip includes an opening that receives a respective panel. For example, as shown in the detailed view of FIG. 6, support clips 524 include notches that hold panels 540 in place. In other embodiments, the opening of the support clip is in the form of a clamp that closes onto the edge of the respective panel. While system 500 includes a single support clip 524 along respective edges of panels 540, in other embodiments, at least some of the panel edges are supported by a plurality of support clips.

In certain embodiments as otherwise described herein, the first portion of panels is disposed in an interior region of the grid. For example, in cladding system 100, the first portion of panels 140 is disposed at the center of grid 114. In some embodiments several portions of panels are disposed in groups in the interior region of the grids.

In certain embodiments as otherwise described herein, the grid cells surrounding the first portion of panels are empty. For example, in cladding system 100, the first portion of panels 140 is surrounded by grid cells 116 that are empty.

In certain embodiments as otherwise described herein, the first portion of panels is disposed at a perimeter of the grid. For example, in some embodiments, the first portion of panels is disposed in a corner of the grid or along a supporting structure.

In certain embodiments as otherwise described herein, all of the cells adjacent to the first portion of panels are empty. For example, in some embodiments, the first portion of panels is disposed at an edge of the grid and the cells that are adjacent to the first portion of panels are empty. In some examples of such an embodiment, the first portion of panels is surrounded by a support structure and by empty cells of the grid.

Figure 14:
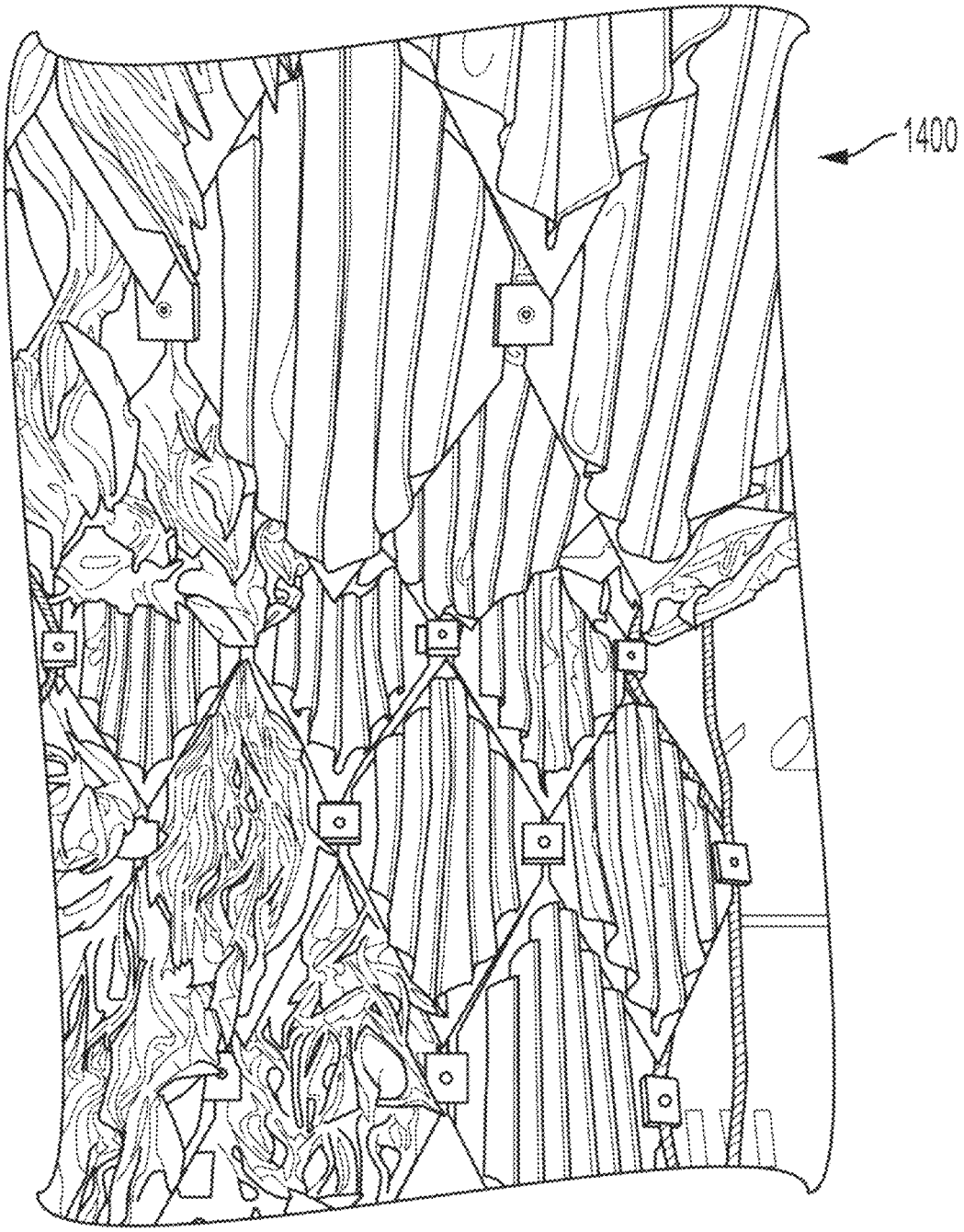
FIG. 14 is a perspective view of a cladding system according to still another embodiment of the disclosure.
Figure 15:
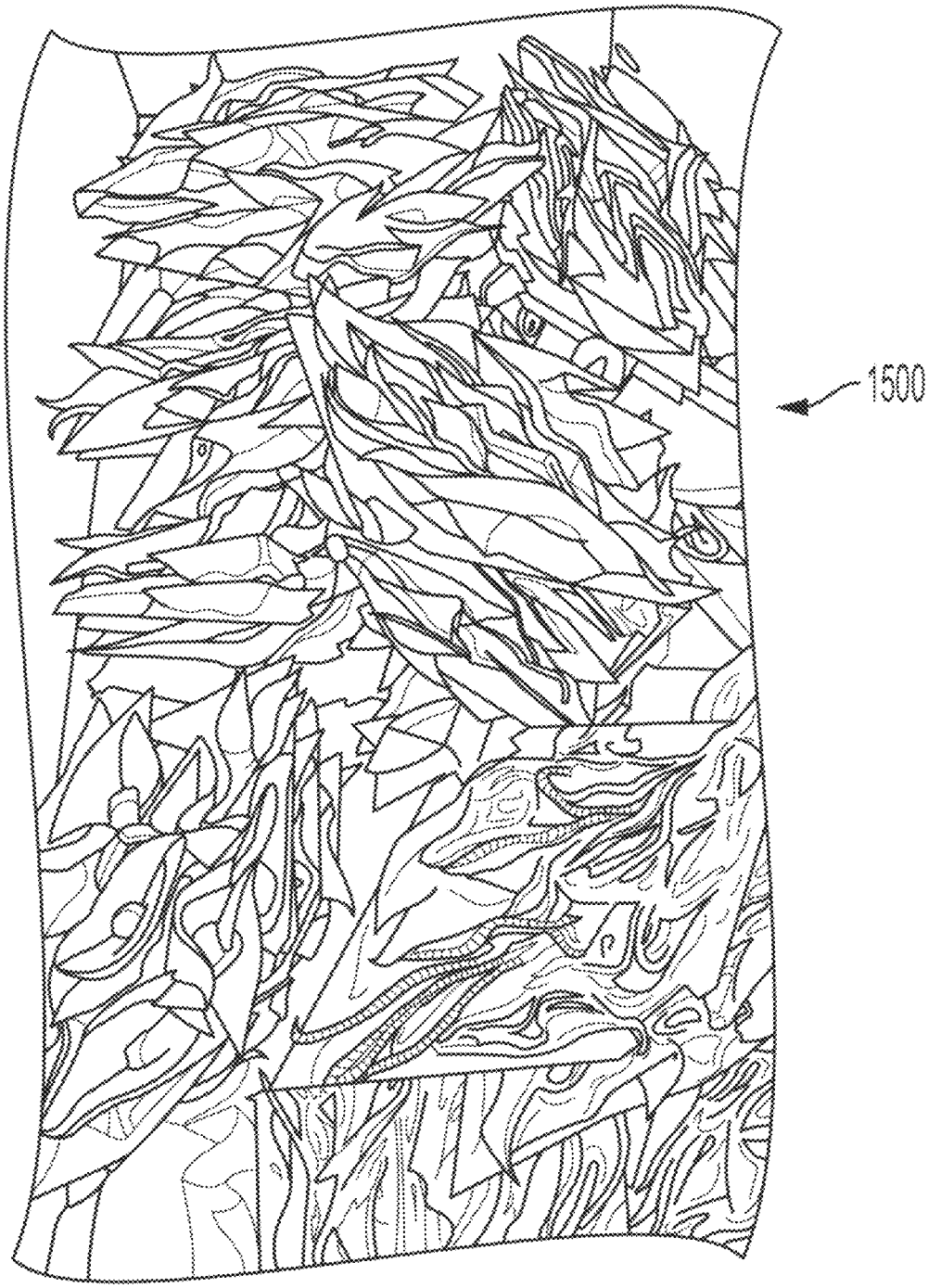
FIG. 15 is a perspective view of a cladding system according to another embodiment of the disclosure.

In certain embodiments the panels include acoustic features on a surface thereof. For example, the panels in cladding systems 1400 and 1500, shown in FIGS. 14 and 15 include enhancing features on a surface thereof. For example, cladding system 1500 includes some panels that have layers of material extending from the surface in the form of baffles and some panels having and undulating projection on the panel surface.

Further aspects of the disclosure are provided by the following listing of enumerated embodiments, which can be combined in any combination and in any number that is not technically or logically inconsistent.

Embodiment 1

A cladding system comprising:

a plurality of flexible grid members arranged so as to form a grid that extends in at least two dimensions and includes grid cells that are delimited by the flexible grid members; and a plurality of panels supported by the grid, at least a first portion of the panels being arranged so as to form an architectural surface.

Embodiment 2

The cladding system according to embodiment 1, wherein the cladding system is a ceiling system, the grid is a ceiling grid, and the first portion of panels forms a ceiling surface that covers a space beneath the ceiling grid.

Embodiment 3

The cladding system according to embodiment 1 or embodiment 2, wherein the flexible grid members are held together at nodes so as to form the grid cells.

Embodiment 4

The cladding system according to any of embodiments 1 to 3, wherein the panels define the shape of the grid cells.

Embodiment 5

The cladding system according to any of embodiments 1 to 4, wherein the grid includes node clips that secure respective flexible grid members together at the nodes.

Embodiment 6

The cladding system according to embodiment 5, wherein the node clips also secure respective panels of the plurality of panels.

Embodiment 7

The cladding system according to any of embodiments 1 to 6, wherein the first portion of panels comprises:

a first panel including a first panel edge, and a second panel including a first panel edge, wherein the first panel edge of the first panel runs parallel and adjacent to the first panel edge of the second panel so as to form a contiguous surface.

Embodiment 8

The cladding system according to embodiment 7, wherein the first panel edge of the first panel abuts the first panel edge of the second panel.

Embodiment 9

The cladding system according to embodiment 7, wherein the first panel edge of the first panel is separated from the first panel edge of the second panel by a gap of no more than 3 inches, e.g., no more than 2 inches, e.g., no more than 1 inch.

Embodiment 10

The cladding system according to any of embodiments 1 to 9, wherein the first portion of panels includes at least 4 panels, e.g., at least 9 panels, e.g., at least 12 panels.

Embodiment 11

The cladding system according to any of embodiments 1 to 10, wherein each of the panels in the first portion includes at least one edge that runs parallel and adjacent to an edge of an adjacent panel.

Embodiment 12

The cladding system according to any of embodiments 1 to 6, wherein each of the panels in the first portion overlaps an adjacent panel.

Embodiment 13

The cladding system according to any of embodiments 1 to 12, wherein the grid includes anchors that secure ends of the flexible grid members to a support structure.

Embodiment 14

The cladding system according to any of embodiments 1 to 13, wherein the grid cells include interior cells surrounded by edge cells at an outer perimeter of the grid.

Embodiment 15

The cladding system according to embodiment 14, wherein substantially all of the interior cells have the same number of sides.

Embodiment 16

The cladding system according to embodiment 14 or embodiment 15, wherein substantially all of the interior cells have a shape selected from a group of no more than five unique shapes, e.g., no more than three unique shapes.

Embodiment 17

The cladding system according to any of embodiments 14 to 16, wherein the interior cells have a quadrilateral shape.

Embodiment 18

The cladding system according to any of embodiments 14 to 16, wherein the interior cells have a triangular shape.

Embodiment 19

The cladding system according to any of embodiments 14 to 18, wherein at least some of the edge cells differ in shape from the interior cells.

Embodiment 20

The cladding system according to any of embodiments 1 to 14, wherein a majority of the grid cells have a unique shape.

Embodiment 21

The cladding system according to any of embodiments 1 to 20, wherein the grid is planar.

Embodiment 22

The cladding system according to any of embodiments 1 to 20, the grid is substantially non-planar, such that the panels provide a three-dimensional ceiling structure.

Embodiment 23

The cladding system according to any of embodiments 1 to 20, wherein the grid is undulating and has a three dimensional shape.

Embodiment 24

The cladding system according to any of embodiments 1 to 23, wherein each of the panels is planar.

Embodiment 25

The cladding system according to any of embodiments 1 to 24, wherein the panels are acoustic tiles.

Embodiment 26

The cladding system according to any of embodiments 1 to 25, wherein the edges of the panels include grooves, and wherein the flexible grid members are inserted into the grooves so as to support the panels.

Embodiment 27

The cladding system according to any of embodiments 1 to 25, wherein the grid includes support clips disposed on the flexible grid members that hold the panels.

Embodiment 28

The cladding system according to embodiment 27, wherein each support clip includes an opening that receives a respective panel.

Embodiment 29

The cladding system according to any of embodiments 1 to 28, wherein the first portion of panels is disposed in an interior region of the grid.

Embodiment 30

The cladding system according to embodiment 29 wherein the grid cells surrounding the first portion of panels are empty.

Embodiment 31

The cladding system according to any of embodiments 1 to 28, wherein the first portion of panels is disposed at a perimeter of the grid.

Embodiment 32

The cladding system according to embodiment 31, wherein the all of the cells adjacent to the first portion of panels are empty.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A cladding system comprising:

a plurality of flexible grid members arranged so as to form a grid that extends in at least two dimensions and includes grid cells that are delimited by the flexible grid members, wherein each of the flexible grid members is formed as a rope, cable, strap, or cord; and a plurality of panels supported by the grid, at least a first portion of the panels being arranged so as to form an architectural surface.

2. The cladding system according to claim 1, wherein the cladding system is a ceiling system, the grid is a ceiling grid, and the first portion of the panels forms a ceiling surface that covers a space beneath the ceiling grid.

3. The cladding system according to claim 1, wherein the flexible grid members are held together at nodes so as to form the grid cells.

4. The cladding system according to claim 1, wherein the panels define the shape of the grid cells.

5. The cladding system according to claim 1, wherein the grid includes node clips that secure the flexible grid members together at nodes.

6. The cladding system according to claim 1, wherein the first portion of panels comprises:

a first panel including a first panel edge, and a second panel including a first panel edge, wherein the first panel edge of the first panel runs parallel and adjacent to the first panel edge of the second panel so as to form a contiguous surface.

7. The cladding system according to claim 6, wherein the first panel edge of the first panel abuts the first panel edge of the second panel.

8. The cladding system according to claim 1, wherein each of the panels in the first portion overlaps an adjacent panel.

9. The cladding system according to claim 1, wherein the grid includes anchors that secure ends of the flexible grid members to a support structure.

10. The cladding system according to claim 1, wherein the grid cells include interior cells surrounded by edge cells at an outer perimeter of the grid, wherein at least some of the edge cells differ in shape from the interior cells.

11. The cladding system according to claim 1, wherein the grid is planar.

12. The cladding system according to claim 1, wherein the grid is undulating and has a three dimensional shape.

13. The cladding system according to claim 1, wherein each of the panels is planar.

14. The cladding system according to claim 1, wherein the panels are acoustic tiles.

15. The cladding system according to claim 1, wherein the edges of the panels include grooves, and wherein the flexible grid members are inserted into the grooves so as to support the panels.

16. The cladding system according to claim 1, wherein the grid includes support clips disposed on the flexible grid members that hold the panels.

17. The cladding system according to claim 1, wherein the first portion of panels is disposed in an interior region of the grid.

18. The cladding system according to claim 17, wherein the grid cells surrounding the first portion of panels are empty.

19. A cladding system comprising:

a plurality of flexible grid members that are adjustable in shape and configured to conform to different shapes, the plurality of flexible grid members being arranged so as to form a grid that extends in at least two dimensions and includes grid cells that are delimited by the flexible grid members; and a plurality of panels supported by the grid, at least a first portion of the panels being arranged so as to form an architectural surface.

20. A cladding system comprising:

a plurality of flexible grid members configured to change shape under the force of gravity when draped over a supporting object, the plurality of flexible grid members being arranged so as to form a grid that extends in at least two dimensions and includes grid cells that are delimited by the flexible grid members; and a plurality of panels supported by the grid, at least a first portion of the panels being arranged so as to form an architectural surface.

* * * * *